US009390902B2

(12) United States Patent
Bezel et al.

(10) Patent No.: US 9,390,902 B2
(45) Date of Patent: Jul. 12, 2016

(54) METHOD AND SYSTEM FOR CONTROLLING CONVECTIVE FLOW IN A LIGHT-SUSTAINED PLASMA

(71) Applicant: KLA-Tencor Corporation, Milpitas, CA (US)

(72) Inventors: Ilya Bezel, Sunnyvale, CA (US); Anatoly Shchemelinin, Pleasanton, CA (US); Matthew Derstine, Los Gatos, CA (US); Kenneth P. Gross, San Carlos, CA (US); David W. Shortt, Los Gatos, CA (US); Wei Zhao, Sunnyvale, CA (US); Anant Chimmalgi, San Jose, CA (US); Jincheng Wang, San Jose, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 0 days.

(21) Appl. No.: 14/224,945

(22) Filed: Mar. 25, 2014

(65) Prior Publication Data

US 2014/0291546 A1 Oct. 2, 2014

Related U.S. Application Data

(60) Provisional application No. 61/806,739, filed on Mar. 29, 2013.

(51) Int. Cl.
*H01J 65/00* (2006.01)

(52) U.S. Cl.
CPC ..... *H01J 65/00* (2013.01)

(58) Field of Classification Search
CPC ..... H01J 65/00
See application file for complete search history.

(56) References Cited

U.S. PATENT DOCUMENTS

| | | | | |
|---|---|---|---|---|
| 3,900,803 | A * | 8/1975 | Silfvast | H01S 3/091 359/345 |
| 6,265,813 | B1 * | 7/2001 | Knox | H01J 65/046 313/113 |
| 7,435,982 | B2 | 10/2008 | Smith | |
| 7,786,455 | B2 * | 8/2010 | Smith | B82Y 10/00 250/493.1 |
| 8,182,127 | B2 * | 5/2012 | Yasuda | H01J 61/025 250/493.1 |
| 8,253,926 | B2 | 8/2012 | Sumitomo et al. | |
| 9,099,292 | B1 | 8/2015 | Bezel et al. | |
| 2005/0167618 | A1 * | 8/2005 | Hoshino | B82Y 10/00 250/504 R |
| 2007/0217732 | A1 | 9/2007 | Chang et al. | |
| 2007/0228300 | A1 * | 10/2007 | Smith | B82Y 10/00 250/504 R |
| 2008/0258085 | A1 * | 10/2008 | Bauer | H05G 2/001 250/504 R |
| 2009/0032740 | A1 * | 2/2009 | Smith | B82Y 10/00 250/503.1 |
| 2011/0085337 | A1 | 4/2011 | Yokota et al. | |
| 2011/0133663 | A1 | 6/2011 | Stockwald | |

(Continued)

FOREIGN PATENT DOCUMENTS

WO 2009073116 A1 6/2009

*Primary Examiner* — Wyatt Stoffa
(74) *Attorney, Agent, or Firm* — Suiter Swantz pc llo

(57) ABSTRACT

A system for controlling convective flow in a light-sustained plasma includes an illumination source configured to generate illumination, a plasma cell including a bulb for containing a volume of gas, a collector element arranged to focus illumination from the illumination source into the volume of gas in order to generate a plasma within the volume of gas contained within the bulb. Further, the plasma cell is disposed within a concave region of the collector element, where the collector element includes an opening for propagating a portion of a plume of the plasma to a region external to the concave region of the collect element.

19 Claims, 5 Drawing Sheets

(56) References Cited

U.S. PATENT DOCUMENTS

2011/0181191 A1* 7/2011 Smith ..... B82Y 10/00 315/149
2011/0291566 A1* 12/2011 Bezel ..... G21B 1/23 315/111.21
2013/0001438 A1* 1/2013 Bezel ..... H01J 61/20 250/492.1
2013/0003384 A1* 1/2013 Bezel ..... G02B 26/06 362/276
2013/0106275 A1* 5/2013 Chimmalgi ..... H01J 61/526 313/39
2015/0034838 A1* 2/2015 Bezel ..... H01J 65/04 250/432 R
2015/0048741 A1* 2/2015 Shortt ..... G21K 5/00 315/111.41

* cited by examiner

METHOD AND SYSTEM FOR CONTROLLING CONVECTIVE FLOW IN A LIGHT-SUSTAINED PLASMA

CROSS-REFERENCE TO RELATED APPLICATION

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the Related application(s)).

RELATED APPLICATIONS

For purposes of the USPTO extra-statutory requirements, the present application constitutes a regular (non-provisional) patent application of United States Provisional patent application entitled INVERTED ELLIPSE, naming Ilya Bezel, Anatoly Shchemelinin, Matthew Derstine, Ken Gross, David Shortt, Wei Zhao, Anant Chimmalgi and Jincheng Wang as inventors, filed Mar. 29, 2013, Application Ser. No. 61/806,739.

TECHNICAL FIELD

The present invention generally relates to plasma based light sources, and more particularly to the use of an inverted collector element to aid in controlling convective flow in a plasma of a plasma based light source.

BACKGROUND

As the demand for integrated circuits having ever-small device features continues to increase, the need for improved illumination sources used for inspection of these ever-shrinking devices continues to grow. One such illumination source includes a laser-sustained plasma source. Laser-sustained plasma light sources are capable of producing high-power broadband light. Laser-sustained light sources operate by focusing laser radiation into a gas volume in order to excite the gas, such as argon or xenon, into a plasma state, which is capable of emitting light. This effect is typically referred to as "pumping" the plasma. The orientation of collection optics below the plasma-generating volume in traditional laser-sustained plasma sources results in plasma convective flow being directed to the internal portion of the source. Traditional sources require convection control, plume capture and temperature control to be implemented within the space inside the ellipsoidal collector optics of traditional sources. In currently implemented systems, a significant amount of effort is directed to the cooling of the top part of the plasma bulb and plasma convection plume mitigation, which is limited by the geometrical constraints resulting from the upward orientation of the collections optics. Air-cooling of the top portion of the plasma bulb causes warm air to propagate inside of the volume designated for laser and plasma light propagation and causes additional noise as a result of air wiggle. In addition, current methods of cooling the top of the plasma bulb via a downward-directed air shower results in air flow counter to the direction of natural convection, which leads to blowing of hotter air on colder bulb parts. In addition, there are severe instabilities in bulb-less system designs in which the convective plume propagates inside of the volume designated for laser and plasma light propagation. Therefore, it would be desirable to provide a system and method for curing defects such as those of the identified above.

SUMMARY

An apparatus for controlling convective flow in a light-sustained plasma is disclosed, in accordance with an illustrative embodiment of the present invention. In one embodiment, the apparatus may include an illumination source configured to generate illumination. In another embodiment, the apparatus may include a plasma cell including a bulb for containing a volume of gas. In another embodiment, the apparatus may include a collector element arranged to focus the illumination from the illumination source into the volume of gas in order to generate a plasma within the volume of gas contained within the bulb. In one embodiment, the collector element may include an ellipsoid-shaped collector element. In another embodiment, the plasma cell is disposed within a concave region of the collector element. In another embodiment, at least a top portion of the collector element is arranged above a plasma-generating region of the plasma cell and is configured to focus illumination from the illumination source into the volume of gas in order to generate a plasma below at least the top portion of the collector element. In another embodiment, the collector element may include an opening for propagating a portion of a plume of the plasma to a region external to the concave region of the collector element. In another embodiment, the opening is positioned substantially in a top portion of the collector element. In another embodiment, the apparatus may include an external plasma control element positioned in the region external to the concave region of the collector element.

An apparatus for controlling convective flow in a light-sustained plasma is disclosed, in accordance with an additional illustrative embodiment of the present invention. In one embodiment, the apparatus may include an illumination source configured to generate illumination. In another embodiment, the collector element may include a concave region for containing a volume of gas. In another embodiment, the collector element is arranged to focus the illumination from the illumination source into the volume of gas in order to generate a plasma within the volume of gas contained by the concave region of the collector element. In one embodiment, the collector element may include an ellipsoid-shaped collector element. In another embodiment, at least a top portion of the collector element is arranged above the volume of gas and is configured to focus illumination from the illumination source into the volume of gas in order to generate a plasma below at least the top portion of the collector element. In another embodiment, the collector element may include an opening for propagating a portion of a plume of the plasma to a region external to the interior region of the collect element. In another embodiment, the opening is positioned substantially in a top portion of the collector element. In another embodiment, the apparatus may include an external plasma control element positioned in the region external to the concave region of the collector element.

A method for controlling convective flow in a light-sustained plasma is disclosed, in accordance with an illustrative embodiment of the present invention. In one embodiment, the method may include providing a collector element, containing a volume of gas within a plasma cell disposed within a concave region of the collector element; forming a plasma within the plasma cell by focusing illumination into the volume of gas contained within the plasma cell, and propagating a portion of a plume of the plasma to a region external to the concave region of the collector element via an opening in the collector element.

A method for correcting convection based aberrations is disclosed, in accordance with an additional illustrative embodiment of the present invention. In one embodiment, the method may include providing a collector element; containing a volume of gas within a concave region of the collector element; forming a plasma within the concave region of the collector element by focusing illumination into the volume of gas contained within the concave region of the collector element; and propagating a portion of a plume of the plasma to a region external to the concave region of the collector element via an opening in the collector element.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

Referring generally to FIGS. 1A through 3, a system and method for controlling convective flow in a light-sustained plasma are described in accordance with the present disclosure. Embodiments of the present invention are directed to the implementation of an inverted collector/reflector element in a light-sustained plasma light source. The inversion of the collector element of the plasma light source of the present invention allows for the plasma plume to propagate from the plasma region of the source to a region outside of the collector boundary via an opening in the collector element. In embodiments where the opening in the collector element is positioned at or near the apex of the collector element, the plume readily propagates (e.g., propagates within a plasma bulb or propagates in a bulb-less setting) upward through the opening into a region above and external to the interior region of the collector element. Such a configuration allows for the implementation of any number of plasma control mechanisms at a location external to the collector element. For instance, the plasma control mechanisms may include, but are not limited to, gas and/or plume cooling and/or heating, convection control, and/or plume capture and/or redirection. It is noted herein that the implementation of plasma control in the region external to the interior region of the collector element serves to remove the various plasma control devices and architecture from the optically active region of the system, thereby alleviating geometrically constraints within the system.

Figure 1A:
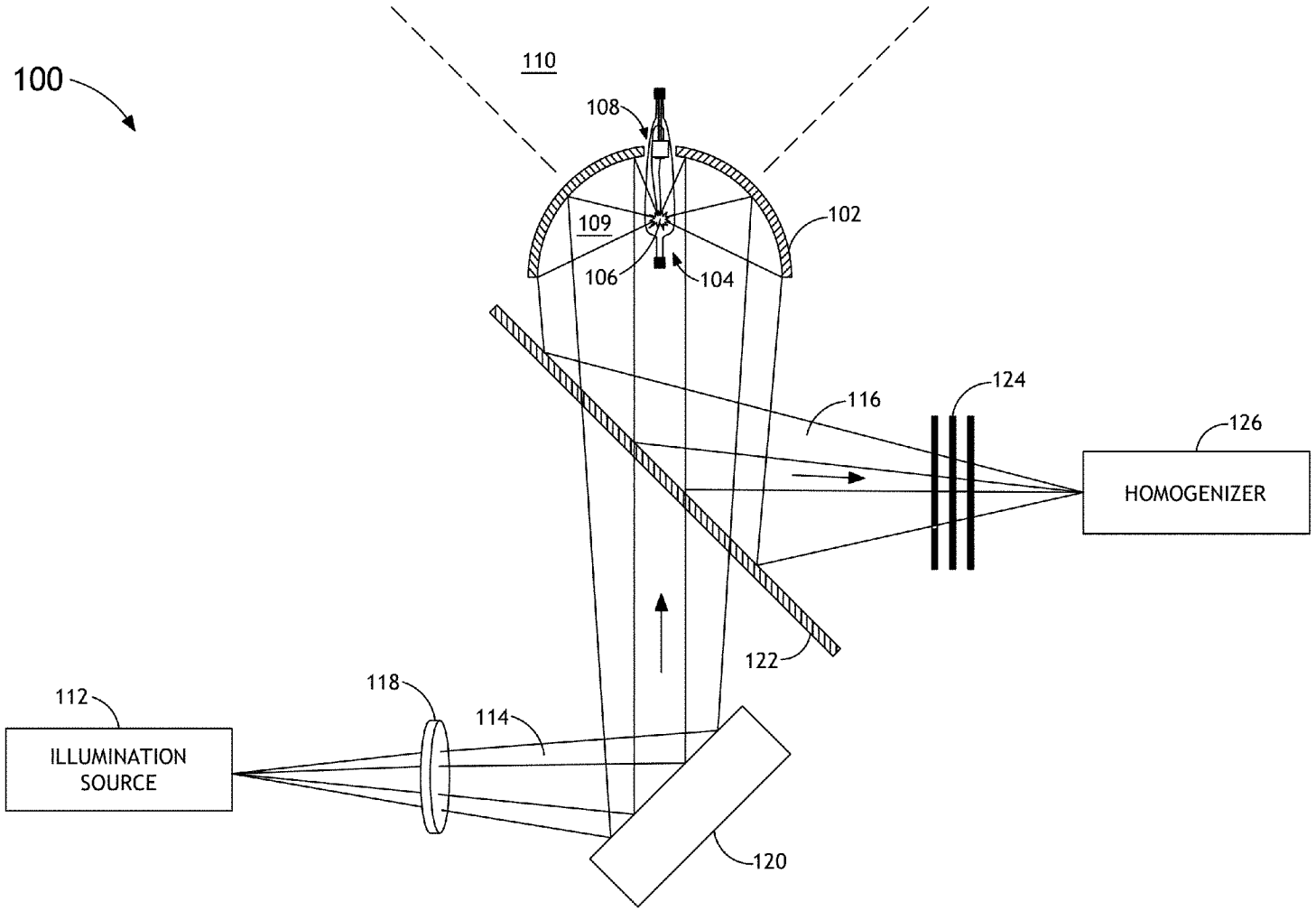
FIG. 1A is a high level schematic view of a system for controlling convective flow in a light-sustained plasma, in accordance with one embodiment of the present invention.
Figure 1B:
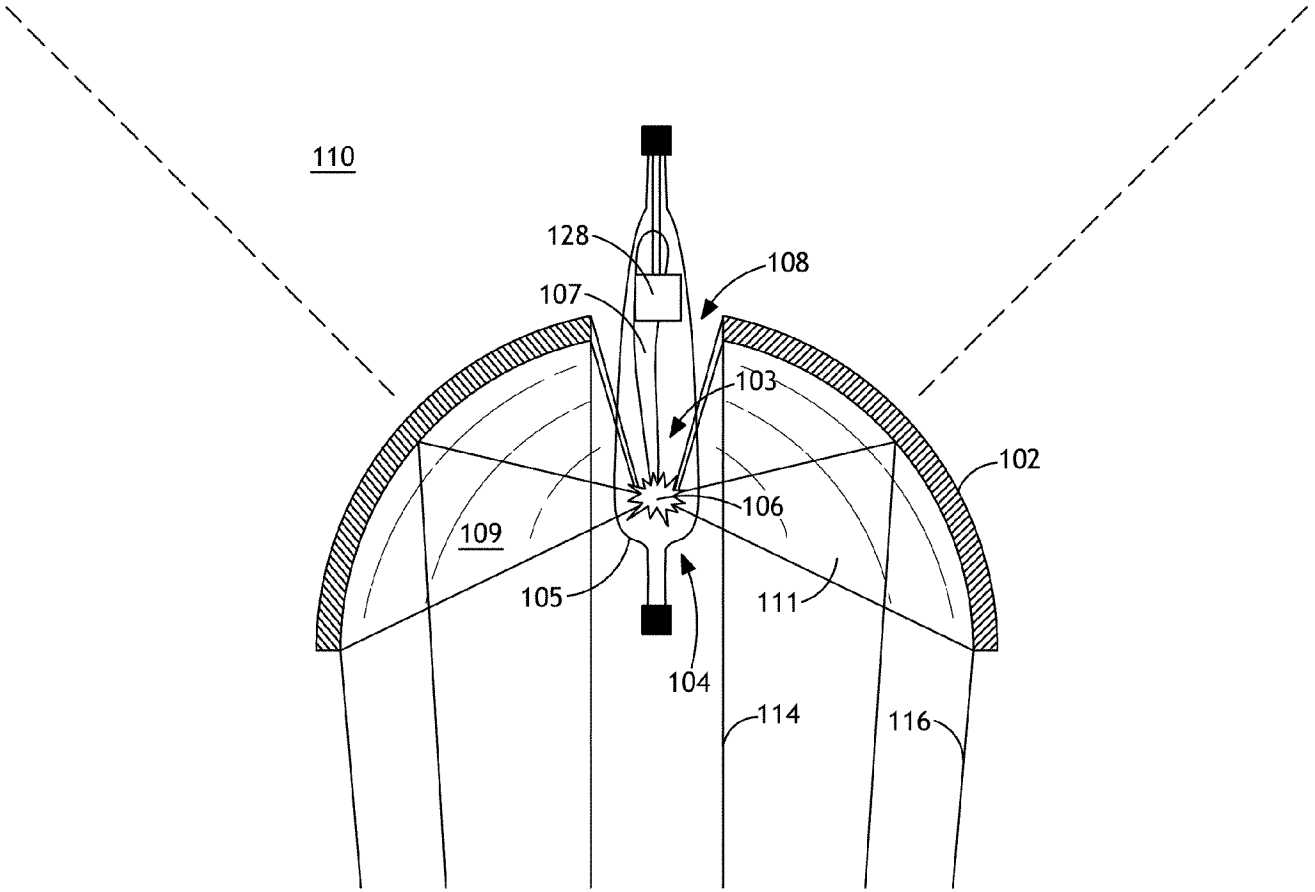
FIG. 1B is a high level schematic view of a collector element and plasma cell of a system for controlling convective flow in a light-sustained plasma, in accordance with one embodiment of the present invention.

FIG. 1A-1B illustrate a system 100 suitable for aiding in convective flow control of plasma in a light-sustained plasma cell, in accordance with one embodiment of the present invention. The generation of plasma within inert gas species is generally described in U.S. patent application Ser. No. 11/695,348, filed on Apr. 2, 2007; and U.S. patent application Ser. No. 11/395,523, filed on Mar. 31, 2006, which are incorporated herein in their entirety. Various plasma cell designs and plasma control mechanisms are described in U.S. patent application Ser. No. 13/647,680, filed on Oct. 9, 2012, which is incorporated herein by reference in the entirety.

In one embodiment, the system 100 includes an illumination source 112 (e.g., one or more lasers) configured to generate illumination of a selected wavelength. In another embodiment, the system 100 includes a plasma cell 104 for generating a plasma. In another embodiment, the plasma cell 104 includes a bulb 105 for containing a selected gas (e.g., argon, xenon, mercury or the like) suitable for generating a plasma upon absorption of suitable illumination. In one embodiment, focusing illumination 114 from the illumination source 112 into the volume of gas 103 causes energy to be absorbed through one or more selected absorption lines of the gas or plasma within the bulb 105, thereby "pumping" the gas species in order to generate or sustain a plasma. In another embodiment, although not shown, the plasma cell 104 may include a set of electrodes for initiating the plasma 106, whereby the illumination source 114 maintains the plasma after ignition by the electrodes.

In another embodiment, the system 100 includes a collector/reflector element 102 (e.g., an ellipsoid-shaped collector element) configured to focus illumination emanating from the illumination source 112 into the volume of gas 103 contained within the bulb 105 of the plasma cell 104. The collector element 102 may take on any physical configuration known in the art suitable for focusing illumination emanating from the illumination source 112 into the volume of gas 103 contained within the bulb 105 of the plasma cell. In one embodiment, the collector element 102 may include a concave region 109 with a reflective internal surface 111 suitable for receiving illumination 114 from the illumination source 112 and focusing the illumination 114 into the volume of gas 103 contained within bulb 105. For example, the collector element 102 may include an ellipsoid-shaped collector element 102 having a reflective internal surface 111, as shown in FIG. 1B. In another embodiment, the collector element 102 is arranged to collect broadband illumination emitted by plasma 106 and direct the broadband illumination to one or more additional optical elements (e.g., homogenizer 126)

In one embodiment, the collector element 102 is arranged such that a top portion of the collector element 102 is positioned above the plasma-generating region of the plasma cell 104, as shown in FIG. 1B. In another embodiment, the collector element 102 is arranged to focus illumination 114 from the illumination source 112 into the volume of gas 103 in order to generate a plasma 106 below at least the top portion of the collector element 102. For example, as shown in FIG. 1B, at least the apex of the collector element 102 is positioned above a portion (e.g., plasma-generating portion) of the bulb 105. In this regard, the internal surface 111 of the concave region 109 is arranged to direct illumination 114 from the illumination source 102 in a downward direction toward the bulb 105 of the plasma cell 104.

In one embodiment, the collector element 102 includes an opening 108 for propagating a portion of a plume 107 of the plasma 106 generated within the bulb 105 to a region 110 external to the concave region 109 of the collect element 102. In one embodiment, as shown in FIG. 1B, a portion of the plasma cell 104 may be positioned so as to pass through opening 108. For example, as shown in FIG. 1B, the bulb 105 of plasma cell 104 may be positioned so as to pass through opening 108. For instance, a first portion of the bulb 105 may be located within the concave region 109, or the internal region, of the collector element 102, while a second portion may be located in a region 110 external to the collector element 102. In this regard, gas or plasma contained within the bulb 105 may traverse from one side of the collector element 102 (e.g., inside collector element) to an opposite side (e.g., outside of collector element), allowing for convective flow between the interior and exterior regions of the collector element 102.

In one embodiment, the plasma cell 104 is arranged within the opening 108 in the collector element 102. In one embodiment, the plasma cell 104 is disposed within the opening 108 of the collector element 102. In another embodiment, a first portion of the plasma cell 104 is placed in thermal communication with the concave region 109 of the collector element 102, while a second portion of the plasma cell 104 is placed in thermal communication with the region 110 external to the concave region 109 of the collector element 102. In another embodiment, a first portion of the bulb 105 of plasma cell 104 is placed in thermal communication with the concave region 109 of the collector element 102, while a second portion of the bulb 105 of plasma cell 104 is placed in thermal communication with the region 110 external to the concave region 109 of the collector element 102.

In one embodiment, the opening 108 is positioned substantially in a top portion of the collector element 102. In another embodiment, the opening 108 is positioned at or near the apex of the collector element. For example, in the case of an ellipsoid-shaped collector element, as shown in FIG. 1B, the opening 108 may be positioned at or near the apex of the ellipsoid-shaped collector element. It is noted herein that the present invention is not limited to the positioning of the opening 108 at or near the apex of the collector element 102. It is further recognized herein that the opening 108, or openings, may be positioned at a variety of locations along the wall of the collector element 102 in order to allow the propagation of a portion of the plume 107 to the external region 110, outside of the concave region 109 of the collector element 102.

The bulb 105 of plasma cell 104 may take on any shape known in the art suitable for traversing the opening between the concave region 109 and the external region 110. For example, the bulb 105 may have, but is not required to have, an elongated shape, as shown in FIG. 1B.

It is noted herein that the inverted orientation of the collector element 102 along with the positioning of the opening 108 at the top portion of the collector element 102 provides for improved thermal control of the bulb 105 of the plasma cell 104. In this regard, the positioning of at least a portion of the bulb (e.g., the top portion of the bulb) outside of the concave region 109 aids in cooling the bulb. Further, the propagation of the plume 107 outside of the concave region 109 aids in mitigating the impact of the plasma plume 107

In another embodiment, the system 100 includes one or more external plasma control elements 128, as shown in FIG. 1B. In one embodiment, the external plasma control element 128 is disposed in the region 110 external to the concave region 109 of the collector element 102. In one embodiment, the external plasma control element 128 is disposed within the bulb 105 of plasma cell 104, as shown in FIG. 1B. In another embodiment, although not shown, the external plasma control element 128 is disposed outside of the bulb 105 of plasma cell 104. For example, the external plasma control element 128 may be affixed to the outside wall of the plasma bulb 105 or may be disposed proximate to the plasma bulb 105.

In one embodiment, the external plasma control element 128 may include any plasma control element known in the art for controlling one or more characteristics of the plasma 106.

In one embodiment, the external plasma control element 128 includes an external temperature control element. For example, an external temperature control element may be disposed inside or outside of the plasma bulb 105 of plasma cell 104. The external temperature control element may include any temperature control element known in the art used to control the temperature of the plasma cell 104, the plasma 106 and/or the plasma plume 107.

In one embodiment, the external temperature control element may be utilized to cool the plasma bulb 105 of plasma cell 104 and/or the plume 107 generated by the plasma 106 by transferring thermal energy to a medium external to the concave region 109 of the collector element 102. In one embodiment, the external temperature control element may include, but is not limited to, a cooling element for cooling the plasma bulb 105. In one embodiment, the external temperature control element may include a heat transfer element for transferring thermal energy from the bulb 105 (or plume 107) to a medium external 110 to the concave region 109 of the collector element 102. For example, the external temperature control unit may include, but is not limited to, a heat pipe (not shown) in thermal communication with one or more portions (e.g., bulb wall, electrodes within bulb and the like) of the plasma bulb 105. Further, the heat pipe may be placed in thermal communication with a heat exchanger (not shown). In this regard, the heat pipe may transfer thermal energy from within the plasma bulb to the heat exchanger disposed at a region external to concave region 109 of the collector element 102. The heat exchanger may be further configured to transfer the received thermal energy from the heat pipe to a medium (e.g., heat sink) external of the plasma bulb 105 and the concave region 109 of the collector element 102. In another embodiment, the heat pipe is configured to transfer thermal energy from the plume 107 generated by rising gas from the plasma region 106 of the plasma bulb 105 to a medium external to concave region 109 of the collector element 102 via the heat exchanger.

In another embodiment, the bulb 105 may include one or more passive heat transfer elements coupled to one or more portions of the bulb 105. For example, the one or more passive heat transfer elements may include, but are not limited to, baffles, chevrons or fins arranged to transfer thermal energy from the hot plasma 106 to a portion of the plasma cell 104 (e.g., top electrode of bulb) to facilitate heat transfer out of the bulb.

In another embodiment, the external temperature control element may be utilized to heat the plasma bulb 105 of plasma cell 104. For example, the external temperature control element may include a heater or heat transfer element (e.g., heat pipe transferring thermal energy from an external medium to the bulb 105) in thermal communication with the plasma bulb and configured to transfer thermal energy to the plasma bulb. For instance, the external temperature control element may include a heater or heat transfer element disposed inside of the plasma bulb 105 or outside of the plasma bulb 105.

The utilization of heat transfer elements is generally described in U.S. patent application Ser. No. 13/647,680, filed on Oct. 9, 2012, which is incorporated by reference above in the entirety. The utilization of heat transfer elements is also generally described in U.S. patent application Ser. No. 12/787,827, filed on May 26, 2010, which is incorporated by reference herein in the entirety.

In another embodiment, the external plasma control element 128 includes an external convection control element. For example, an external convection control element may be disposed inside or outside of the plasma bulb 105 of plasma cell 104. The external convection control element may include any convection control device known in the art used to control convection in the plasma cell 104. For example, the external convection control element may include one or more devices (e.g., structures positioned within plasma cell 104) suitable for controlling convection currents within the plasma bulb 105 of plasma cell 104. For instance, the one or more structures for controlling convection currents may be arranged within the plasma bulb 105 in a manner to impact the flow of hot gas from the hot plasma region 106 of the plasma cell 104 to the cooler inner surfaces of the glass bulb 105. In this regard, the one or more structures may be configured in a manner to direct convective flow to regions within the plasma bulb 105 that minimize or at least reduce damage to the bulb 105 caused by the high temperature gas.

The utilization of convection control devices is generally described in U.S. patent application Ser. No. 13/647,680, filed on Oct. 9, 2012, which is incorporated by reference above in the entirety. The utilization of convection control devices are also generally described in U.S. patent application Ser. No. 12/787,827, filed on May 26, 2010, which is incorporated by reference above in the entirety.

In another embodiment, the external plasma control element 128 includes an external plume capture element. For example, an external plume capture element may be disposed inside or outside of the plasma bulb 105 of plasma cell 104. The external plume control element may include any plume control device known in the art used to capture or redirect the plume 107 of plasma 106 within the plasma cell 104. For example, the external plume capture element may include one or more devices having a concave portion suitable for capturing and redirecting a convection plume emanating from the plasma region 106 within the bulb 105 of the plasma cell 104. For instance, the external plume capture element may include one or more electrodes (e.g., top electrode) disposed within the plasma bulb 105 of plasma cell 104 having a concave portion or a hollow portion suitable for capturing and/or redirecting a convection plume emanating from the plasma region 106 within the bulb 105 of the plasma cell 104

The utilization of plume capture devices is generally described in U.S. patent application Ser. No. 13/647,680, filed on Oct. 9, 2012, which is incorporated by reference above in the entirety. The utilization of plume capture devices is also generally described in U.S. patent application Ser. No. 12/787,827, filed on May 26, 2010, which is incorporated by reference above in the entirety.

Figure 1C:
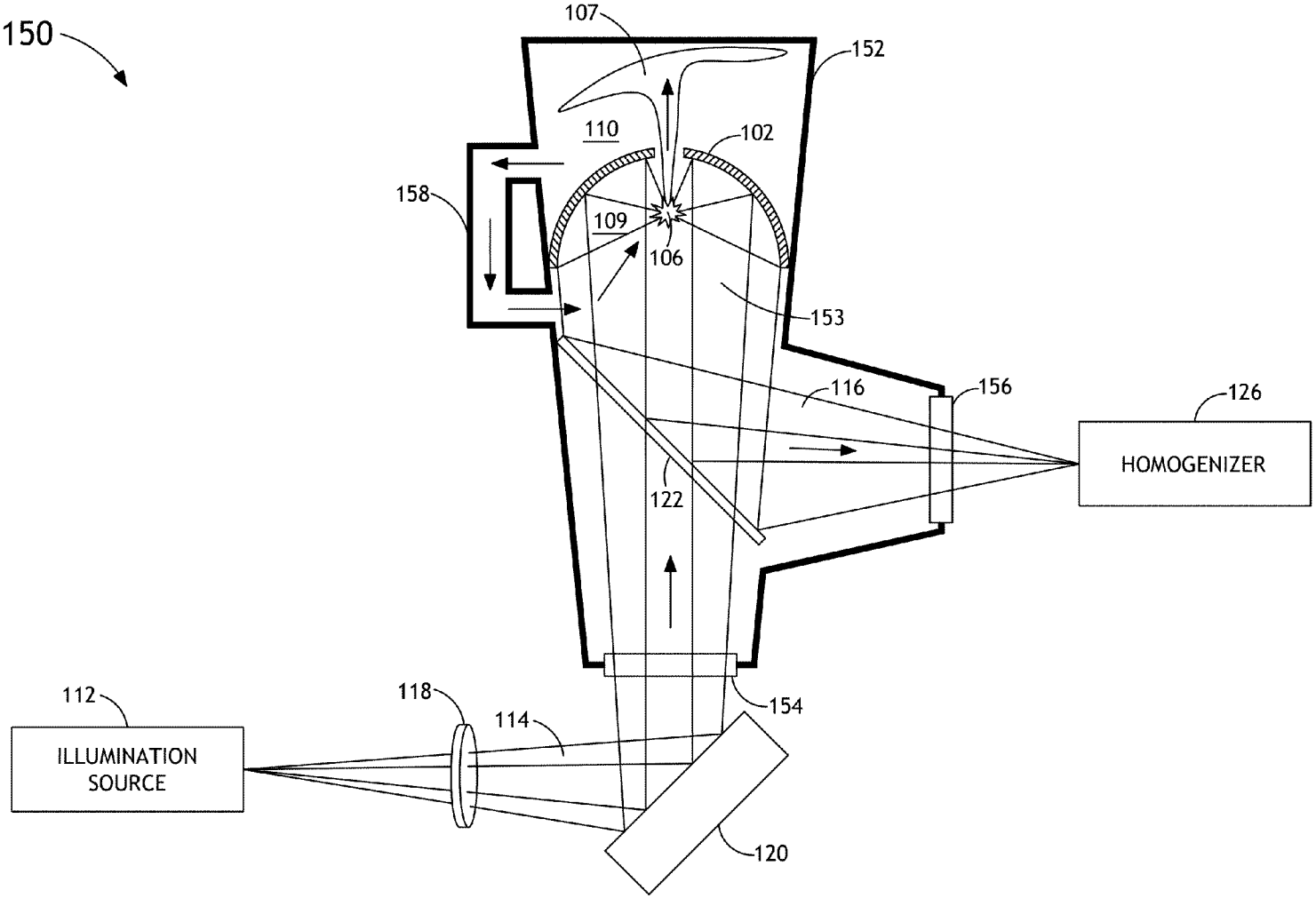
FIG. 1C is a high level schematic view of a bulb-less system for controlling convective flow in a light-sustained plasma, in accordance with one embodiment of the present invention.

FIG. 1C illustrates a system 150 suitable for aiding in convective flow control of plasma, in accordance with one embodiment of the present invention. It is noted herein that system 150 is suitable for generating a plasma without the use of a plasma bulb. In this regard, system 150 may be referred to herein as a "bulb-less" system design. It is further noted that the various embodiments and illustrations provided previously herein with respect to system 100 should be interpreted to extend to system 150 unless otherwise noted.

In one embodiment, the collector element 102 is configured to contain, or at least contribute to the containment, of a volume of gas suitable for generating plasma. In another embodiment, the collector element 102 is arranged to focus the illumination 114 from the illumination source 112 into the volume of gas 153 in order to generate, or at least maintain, a plasma 106 within the volume of gas 153 contained by at least the concave region 109 of the collector element 102. In another embodiment, the collector element 102 is arranged to collect broadband illumination emitted by plasma 106 and direct the broadband illumination to one or more additional optical elements (e.g., homogenizer 126).

In one embodiment, the system 150 includes a gas containment structure 152. In another embodiment, the gas containment structure 152 is operably coupled to the collector element 102. For example, as shown in FIG. 1C, the collector element 102 is disposed inside containment structure 152. In another embodiment, although not shown, the collector element 102 may be disposed on an upper portion of the containment structure 152. It is noted herein that the present invention is not limited to the above description or the depiction of system 150 in FIG. 1C as it is contemplated herein that system 150 may encompass a number of bulb-less configurations suitable for initiating and/or maintaining a plasma in accordance with the present invention. A bulb-less laser sustained plasma light source is generally described in U.S. patent application Ser. No. 12/787,827, filed on May 26, 2010, which is incorporated above by reference in the entirety.

As previously described herein, the system 150 includes an opening 108 for propagating a portion of the plume 107 of the plasma 106 to a region 110 external to the concave region 109 of the collector element 102. In this regard, gas or plasma contained within the collector element 102 may traverse from one side of the collector element 102 (e.g., inside collector element) to an opposite side (e.g., outside of collector element) via opening 108, allowing for convective flow between the interior and exterior regions of the collector element 102.

In another embodiment, the system 150 includes a gas circulation system 158. For example, the gas circulation system 158 may transfer gas from the external region 110 to the interior concave region 109. In this regard, the gas circulation system 158 may transfer cooled gas (after heat transfer from the plume 107 to a medium (e.g., heat sink)) back into the plasma generating region 106 of the interior concave region 109. In another embodiment, although not shown, the as circulation system 158 may include one or more gas pumps for facilitating circulation of gas.

In another embodiment, the system 150 includes one or more windows 154 coupled to the gas containment structure 152 and arranged to allow incident illumination 114 from the illumination source 112 to enter the volume of the gas containment structure 152 and the concave region 109 of the collector element 102. The window 154 may include any window material known in the art suitable for transmitting light, such as laser light, from the illumination source 112 to the inside of the containment structure 152.

In one embodiment, although not shown in FIG. 1C, the system 150 may include an external plasma control element. In one embodiment, as discussed previously herein, the external plasma control element may be positioned in the region 110 external to the concave region 109 of the collector element 102. In one embodiment, the external plasma control element of system 150 may include any plasma control element known in the art for controlling one or more characteristics of the plasma 106 in a bulb-less system, such as system 150. In one embodiment, the external plasma control element of system 150 may be disposed on, or integrated with, a portion of the gas containment structure 152, a portion of the external wall of the collector element 102 and/or a portion of the gas circulation system 158.

In one embodiment, the external plasma control element of system 150 may include an external temperature control element. For example, as discussed previously herein, the external temperature control element may include, but is not limited to, any heating element, cooling element or heat transfer element known in the art. For instance, the external temperature control element may include any heating element, cooling element or heat transfer element known in the art suitable for cooling and/heating gas or the plasma plume 107, which propagates through opening 108 and through the external region 110. In one embodiment, the temperature control element may include a temperature control element that is external to the concave region, but internal to the gas containment structure 152. For instance, the temperature control element may include one or more cooling pipes disposed in region 110, outside of concave region 109, but within the containment structure 152, and is configured to cool the hot gas and/or plume 107 as it rises from the hot plasma 106. In another embodiment, the temperature control element may include a temperature control element that is external to the concave region the gas containment structure 152. For instance, the system 150 may include a cooling jacket (not shown) or cooling collar (not shown) disposed around a portion of the gas containment structure 152 and configured to cool the hot gas and/or plume 107 as it rises from the hot plasma 106. Temperature control systems and devices usable in the context of system 150 are generally described in U.S. patent application Ser. No. 13/647,680, filed on Oct. 9, 2012; and U.S. patent application Ser. No. 12/787,827, filed on May 26, 2010, which are both incorporated by reference above in the entirety.

In another embodiment, the external plasma control element of system 150 may include an external convection control element. In one embodiment, the gas circulation system 158 may contribute to the convection control of system 150 by controlling convection associated with hot gas rising from the plasma 106 into the external region 110 through opening 108, as discussed previously herein. In one embodiment, the convection control imparted by the gas circulation system 158 may include passive convection control, whereby gas, upon cooling, naturally circulates through the circulation system 158 back into the concave region 109. In another embodiment, the convection control imparted by the gas circulation system 158 may include active convection control. For example, the gas control system 158 may include a pump configured to pump gas from the external region 110 to the concave region 109. It is recognized herein that in the bulb-less system 150 the convection control may be coupled to cooling/heating control. For example, cooling elements (e.g., cooling jacket) located at one or more positions of the gas containment structure 152, gas circulation system 158, the external region 110 and/or the concave region 109 may be used to control convection throughout the system. Convection control systems and devices usable in the context of system 150 are generally described in U.S. patent application Ser. No. 13/647,680, filed on Oct. 9, 2012; and U.S. patent application Ser. No. 12/787,827, filed on May 26, 2010, which are both incorporated by reference above in the entirety.

In another embodiment, the external plasma control element of system 150 may include an external plume capture element. The external plume control element may include any plume control device known in the art suitable to capture or redirect the plume 107 of plasma 106 in the region 110 external to the concave region 109. For example, the external plume capture element may include one or more devices having a concave portion suitable for capturing and redirecting a convection plume 107 propagating through opening 108 from the plasma region 106. For instance, the external plume capture element may include one or more devices (e.g., top electrode) disposed within region 110 having a concave portion or a hollow portion suitable for capturing and/or redirecting a convection plume emanating from opening 108. Plume capture devices usable in the context of system 150 are generally described in U.S. patent application Ser. No. 13/647,680, filed on Oct. 9, 2012; and U.S. patent application Ser. No. 12/787,827, filed on May 26, 2010, which are both incorporated by reference above in the entirety.

In another embodiment, the system 150 includes one or more windows 156 for transmitting generated broadband light (e.g., broadband UV light) from the plasma 106 to one or more optical elements situated outside of the gas containment structure 152. The window 156 may include any window material known in the art suitable for transmitting light, such as broadband UV light, from the plasma-generating region within the containment structure 152 to one or more optical elements situated outside of the gas containment structure 152.

In one embodiment, systems 100 and 150 may include various additional optical elements. In one embodiment, the set of additional optics may include collection optics configured to collect broadband light emanating from the plasma 106 (e.g., plasma in bulb 105 of system 100 or plasma maintained in concave region 109 of system 150). For instance, the systems 100 and 150 may include a cold mirror 122 arranged to direct illumination from the collector element 102 to downstream optics, such as, but not limited to, a homogenizer 126.

In another embodiment, the set of optics may include one or more additional lenses (e.g., lens 118) placed along either the illumination pathway or the collection pathway of system 100 or system 150. The one or more lenses may be utilized to focus illumination from the illumination source 112 into the volume of gas 103 or 153. Alternatively, the one or more additional lenses may be utilized to focus broadband light emanating from the plasma 106 onto a selected target (not shown). In a further embodiment, the set of optics may include one or more filters 124 (not shown in FIG. 1C) placed along either the illumination pathway or the collection pathway in order to filter illumination prior to light entering the plasma bulb 105 (or the concave region 109 of collector element 102) or to filter illumination following emission of the light from the plasma 106. It is noted herein that the set of optics of systems 100 and 150 as described above and illustrated in FIGS. 1A through 1C are provided merely for illustration and should not be interpreted as limiting. It is anticipated that a number of equivalent optical configurations may be utilized within the scope of the present invention.

It is contemplated herein that the systems 100 and 150 may be utilized to sustain a plasma in a variety of gas environments. In one embodiment, the gas used to initiate and/or maintain plasma 106 may include an inert gas (e.g., noble gas or non-noble gas) or a non-inert gas (e.g., mercury). In another embodiment, the gas used to initiate and/or maintain a plasma 106 may include a mixture of gases (e.g., mixture of inert gases, mixture of inert gas with non-inert gas or a mixture of non-inert gases). For example, it is anticipated herein that the volume of gas 103 or 153 used to generate a plasma 106 may include argon. For instance, the gas 103 or 153 may include a substantially pure argon gas held at pressure in excess of 5 atm. In another instance, the gas may include a substantially pure krypton gas held at pressure in excess of 5 atm. In another instance, the gas 103 or 153 may include a mixture of argon gas with an additional gas.

It is further noted that the present invention may be extended to a number of gases. For example, gases suitable for implementation in the present invention may include, but are not limited, to Xe, Ar, Ne, Kr, He, $N_2$, $H_2O$, $O_2$, $H_2$, $D_2$, $F_2$, $CH_4$, one or more metal halides, a halogen, Hg, Cd, Zn, Sn, Ga, Fe, Li, Na, Ar:Xe, ArHg, KrHg, XeHg, and the like. In a general sense, the present invention should be interpreted to extend to any light pump plasma generating system and should further be interpreted to extend to any type of gas suitable for sustaining a plasma within a plasma cell or within a bulb-less system, such as system 150.

In another embodiment, the illumination source 112 of system 100 or system 150 may include one or more lasers. In a general sense, the illumination source 112 may include any laser system known in the art. For instance, the illumination source 112 may include any laser system known in the art capable of emitting radiation in the visible or ultraviolet portions of the electromagnetic spectrum. In one embodiment, the illumination source 112 may include a laser system configured to emit continuous wave (CW) laser radiation. For example, in settings where the gas of the volume 103 or 153 is or includes argon, the illumination source 112 may include a CW laser (e.g., fiber laser or disc Yb laser) configured to emit radiation at 1069 nm. It is noted that this wavelength fits to a 1068 nm absorption line in argon and as such is particularly useful for pumping the argon gas. It is noted herein that the above description of a CW laser is not limiting and any CW laser known in the art may be implemented in the context of the present invention.

In another embodiment, the illumination source 112 may include one or more diode lasers. For example, the illumination source 112 may include one or more diode laser emitting radiation at a wavelength corresponding with any one or more absorption lines of the species of the gas contained within volume 103 or volume 153. In a general sense, a diode laser of the illumination source 112 may be selected for implementation such that the wavelength of the diode laser is tuned to any absorption line of any plasma (e.g., ionic transition line) or any absorption line of the plasma-producing gas (e.g., highly excited neutral transition line) known in the art. As such, the choice of a given diode laser (or set of diode lasers) will depend on the type of gas contained within the plasma cell 104 of system 100 or the concave region 109 of system 150 of the present invention.

In another embodiment, the illumination source 112 may include an ion laser. For example, the illumination source 112 may include any noble gas ion laser known in the art. For instance, in the case of an argon-based plasma, the illumination source 112 used to pump argon ions may include an Ar+ laser.

In another embodiment, the illumination source 112 may include one or more frequency converted laser systems. For example, the illumination source 112 may include a Nd:YAG or Nd:YLF laser having a power level exceeding 100 Watts. In another embodiment, the illumination source 112 may include a broadband laser. In another embodiment, the illumination source may include a laser system configured to emit modulated laser radiation or pulsed laser radiation.

In another embodiment, the illumination source 112 may include one or more non-laser sources. In a general sense, the illumination source 112 may include any non-laser light source known in the art. For instance, the illumination source 112 may include any non-laser system known in the art capable of emitting radiation discretely or continuously in the visible or ultraviolet portions of the electromagnetic spectrum.

In another embodiment, the illumination source 112 may include two or more light sources. In one embodiment, the illumination source 112 may include or more lasers. For example, the illumination source 112 (or illumination sources) may include multiple diode lasers. By way of another example, the illumination source 112 may include multiple CW lasers. In a further embodiment, each of the two or more lasers may emit laser radiation tuned to a different absorption line of the gas or plasma within the plasma cell 104 of system 100 or the concave region 109 of system 150.

Figure 2:
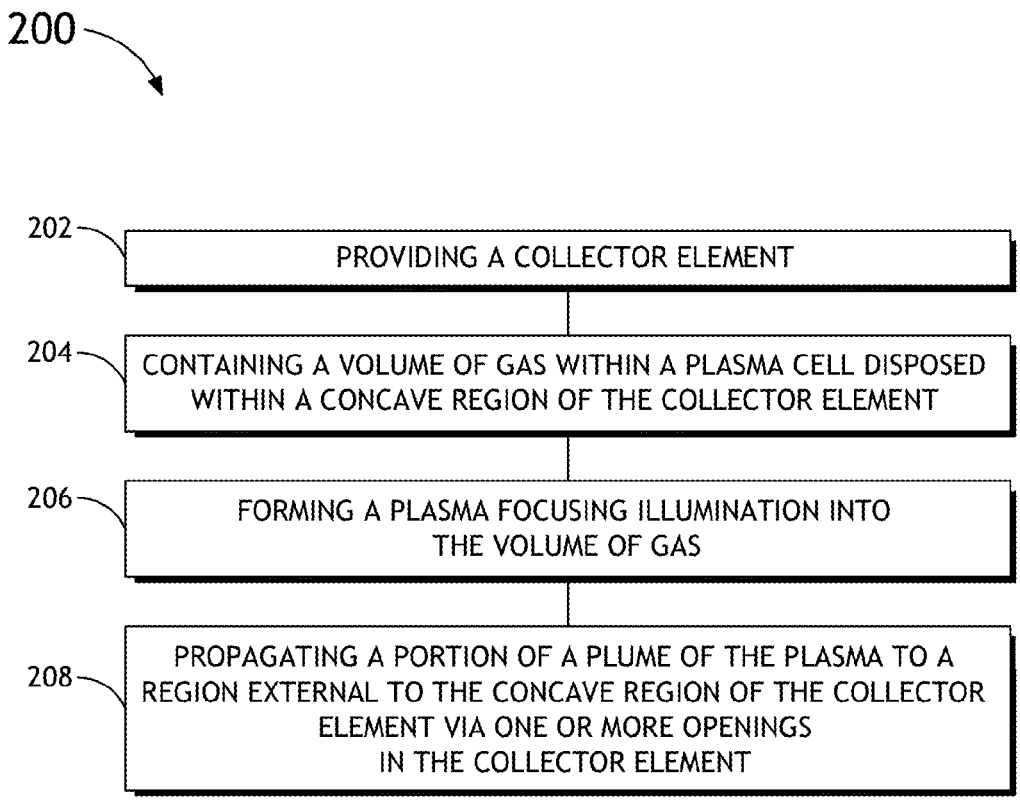
FIG. 2 is a flow diagram illustrating a method for controlling convective flow in a light-sustained plasma, in accordance with one embodiment of the present invention.

FIG. 2 is a flow diagram illustrating steps performed in a method 200 for controlling convective flow in a light-sustained plasma. Applicant notes that the embodiments and enabling technologies described previously herein in the context of systems 100 and 150 should be interpreted to extend to method 200. It is further noted, however, that the method 200 is not limited to the architecture of systems 100 and 150.

In a first step 202, a collector element 102 is provided. For example, as shown in FIGS. 1A and 1B, a collector element 102 having a generally ellipsoidal shape and an internal reflective surface 111 may be provided. Further, the collector element 102 may be arranged such that it directs illumination 114 from the illumination source 112 in a generally down direction to a volume of gas 103 below at least the top portion of the collector element 102.

In a second step 204, a volume of gas 103 is contained within a plasma cell disposed within a concave region 109 of the collector element 102. For example, the system 100 may include a plasma cell 104 disposed within the concave region 109 of the collector element 102. For instance, the plasma cell 104 may include a bulb 105 suitable for containing a volume of gas (e.g., pure gas or gas mixture).

In a third step 206, a plasma within the plasma cell is formed by focusing illumination into the volume of gas contained within the plasma cell. For example, illumination 114 of a selected wavelength may be generated utilizing an illumination source 112, such as a laser. In turn, the illumination is focused into the volume of gas 103 in order to generate plasma 106 within the volume of gas 103. For example, the collector element 102 may receive illumination 114 from the illumination source 112 and focus the illumination into the gas 103 contained within the bulb 105 of the plasma cell 104. It is noted herein that the plasma 106 need not be initiated by the light 114 from the illumination source 102. For example, one or more electrodes (not shown) may be utilized to initiate the plasma 106, while light 114 is used to maintain the plasma 106.

In a fourth step 208, a portion of a plume of the plasma is propagated to a region 110 external to the concave region 109 of the collector element 102 via an opening 108 in the collector element 102. For example, the bulb 105 of plasma cell 104 may be disposed within an opening 108 of the collector element 102 such that the bulb 105 is in contact with the interior concave region 109 as well as the external region 110. For instance, the opening 108 may be arranged in the top portion (e.g., at or near the apex) of the collector element 102.

Figure 3:
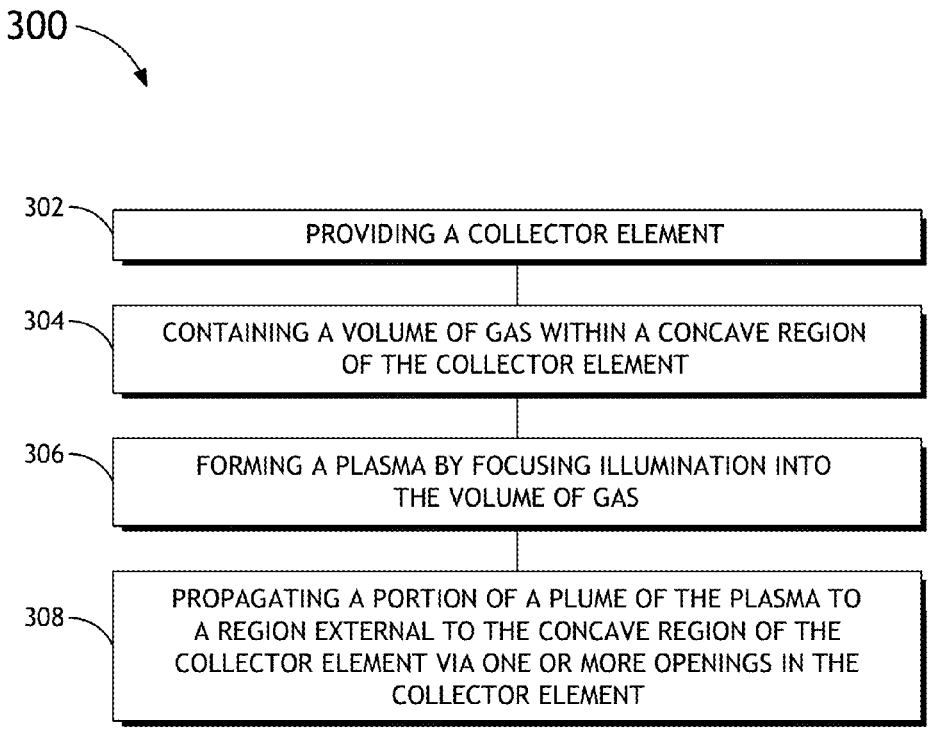
FIG. 3 is a flow diagram illustrating a method for controlling convective flow in a light-sustained plasma, in accordance with one embodiment of the present invention.

FIG. 3 is a flow diagram illustrating steps performed in a method 300 for controlling convective flow in a light-sustained plasma. Applicant notes that the embodiments and enabling technologies described previously herein in the context of systems 100 and 150 should be interpreted to extend to method 300. It is further noted, however, that the method 300 is not limited to the architecture of systems 100 and 150.

In first step 302, a collector element is provided. For example, as shown in FIG. 1C, a collector element 102 having a generally ellipsoidal shape and an internal reflective surface 111 may be provided. Further, the collector element 102 may be arranged such that it directs illumination 114 from the illumination source 102 in a generally down direction to a volume of gas 103 below at least the top portion of the collector element 102.

In a second step 304, a volume of gas is contained within a concave region of the collector element. For example, as shown in FIG. 1C, the concave region 109 of the collector element 102 may serve to at least partially contain the volume of gas 153. Further, as shown in FIG. 1C, the concave region 109 may operate, although is not required to operate, in concert with a gas containment structure 152 to contain the volume of gas 153.

In third step 306, a plasma is within the concave region of the collector element by focusing illumination into the volume of gas contained within the concave region of the collector element. For example, illumination 114 of a selected wavelength may be generated utilizing an illumination source 112, such as a laser. In turn, the illumination is focused into the volume of gas 153 in order to generate plasma 106 within the volume of gas 153. For instance, the collector element 102 may receive illumination 114 from the illumination source 112 and focus the illumination into the gas 153 contained within the concave region 109 of the collector element 102. It is noted herein that the plasma 106 need not be initiated by the illumination 114 from the illumination source 102. For example, one or more electrodes (not shown) may be utilized to initiate the plasma 106, while the illumination 114 is used to maintain the plasma 106.

In a fourth step 308, a portion of a plume 107 of the plasma 106 is propagated to a region 110 external to the concave region 109 of the collector element 102 via an opening 108 in the collector element 102. For example, as shown in FIG. 1C, the opening 108 may be arranged in the top portion (e.g., at or near the apex) of the collector element 102 such that the plume 107 generated by the generation of plasma 106 pass through the opening 108 into the region 110 external to the concave region 109 of the collector element 102.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically mateable and/or physically interacting components and/or wirelessly interactable and/or wirelessly interacting components and/or logically interacting and/or logically interactable components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. An apparatus for controlling convective flow in a light-sustained plasma, comprising:

an illumination source configured to generate illumination;

a plasma cell, the plasma cell including a bulb for containing a volume of gas; and a collector element arranged to focus the illumination from the illumination source into the volume of gas in order to generate a plasma within the volume of gas contained within the bulb, at least a portion of the plasma cell disposed within a concave region of the collector element, the collector element including an opening, wherein a portion of the plasma cell passes through the opening of the collector element to propagate a portion of a plume of the plasma to a region external to the concave region of the collector element.

2. The apparatus of claim 1, wherein at least a top portion of the collector element is arranged above a plasma-generating region of the plasma cell and is configured to focus illumination from the illumination source into the volume of gas in order to generate a plasma below at least the top portion of the collector element.

3. The apparatus of claim 1, wherein the collector element is arranged to collect broadband illumination emitted by the generated plasma and direct the broadband illumination to one or more additional optical elements.

4. The apparatus of claim 1, wherein the collector element comprises:

an ellipsoid-shaped collector element.

5. The apparatus of claim 1, wherein the opening in the collector element comprises:

an opening positioned substantially in a top portion of the collector element.

6. The apparatus of claim 5, wherein the opening in the collector element comprises:

an opening positioned substantially at an apex of the collector element.

7. The apparatus of claim 1, wherein the plasma cell is arranged within the opening in the collector element, wherein a first portion of the plasma cell is in thermal communication with the concave region of the collector element, wherein a second portion of the plasma cell is in thermal communication with the region external to the concave region of the collector element.

8. The apparatus of claim 1, further comprising:

an external plasma control element positioned in the region external to the concave region of the collector element, wherein the external plasma control element includes at least one of a structure disposed inside the plasma bulb or a structure disposed outside of the plasma bulb.

9. The apparatus of claim 8, wherein the external plasma control element comprises:

an external plume capturing element, wherein the external plume capturing element includes a concave portion for at least one of capturing or redirecting a plume of the plasma.

10. The apparatus of claim 8, wherein the external plasma control element comprises:

an external convection control element, wherein the external convection control element is disposed inside the plasma bulb and is arranged to control convention currents within the plasma bulb.

11. The apparatus of claim 8, wherein the external plasma control element comprises:

an external temperature control element, wherein the external temperature control element is coupled to one or more portions of the plasma bulb.

12. The apparatus of claim 1, wherein the illumination source comprises:

one or more lasers.

13. The apparatus of claim 12, wherein the one or more lasers comprise:

at least one of a diode laser, a continuous wave laser, or a broadband laser.

14. The apparatus of claim 1, wherein the gas comprises:

one or more inert gases.

15. The apparatus of claim 1, wherein the gas comprises:

one or more non-inert gases.

16. The apparatus of claim 1, wherein the gas comprises:

a mixture of two or more gases.

17. A method for controlling convective flow in a light-sustained plasma comprising:

providing a collector element;

containing a volume of gas within a plasma cell disposed within a concave region of the collector element;

forming a plasma within the plasma cell by focusing illumination into the volume of gas contained within the plasma cell; and propagating a portion of a plume of the plasma to a region external to the concave region of the collector element via an opening in the collector element.

18. The method of claim 17, wherein the providing a collector element comprises:

providing a collector element arranged such that a top portion of the collector element is substantially above a plasma generating region of the plasma cell.

19. The method of claim 17, further comprising:

controlling one or more characteristics of the portion of the plume propagated to the region external to the concave region of the collector element.

* * * * *